United States Patent [19]

Wells

[11] 4,428,323

[45] Jan. 31, 1984

[54] CHAMBER BLOCK HAVING A SAMPLE DAM AND A SUPERNATANT REENTRY BARRIER THEREIN

[75] Inventor: John R. Wells, Culver City, Calif.

[73] Assignee: E. I. Du Pont de Nemours and Company, Wilmington, Del.

[21] Appl. No.: 443,859

[22] Filed: Nov. 22, 1982

[51] Int. Cl.[3] ..... B05C 13/02; B04B 11/00

[52] U.S. Cl. ..... 118/52; 118/50; 427/2; 427/240; 494/61

[58] Field of Search ..... 427/2; 118/52, 410, 118/407, 50; 494/61, 10, 85, 4

[56] References Cited

U.S. PATENT DOCUMENTS

| | | | |
|---|---|---|---|
| 1,751,982 | 3/1930 | Dunham | 494/4 X |
| 2,233,855 | 3/1941 | Suss | 494/4 X |
| 2,654,536 | 10/1953 | Heckendorf | 494/4 |
| 4,306,514 | 12/1981 | Bouclier | 118/52 |
| 4,314,523 | 2/1982 | Boeckel | 118/50 |
| 4,327,661 | 5/1982 | Boeckel | 118/52 |

*Primary Examiner*—Robert W. Jenkins

[57] ABSTRACT

A chamber block for a centrifuge has a sample inlet channel at the lower end of which is disposed a dam to prevent run-through of a sample, and barrier to prevent re-entry of supernatant from a supernatant collection vial into the block.

4 Claims, 3 Drawing Figures

Fig. 1.
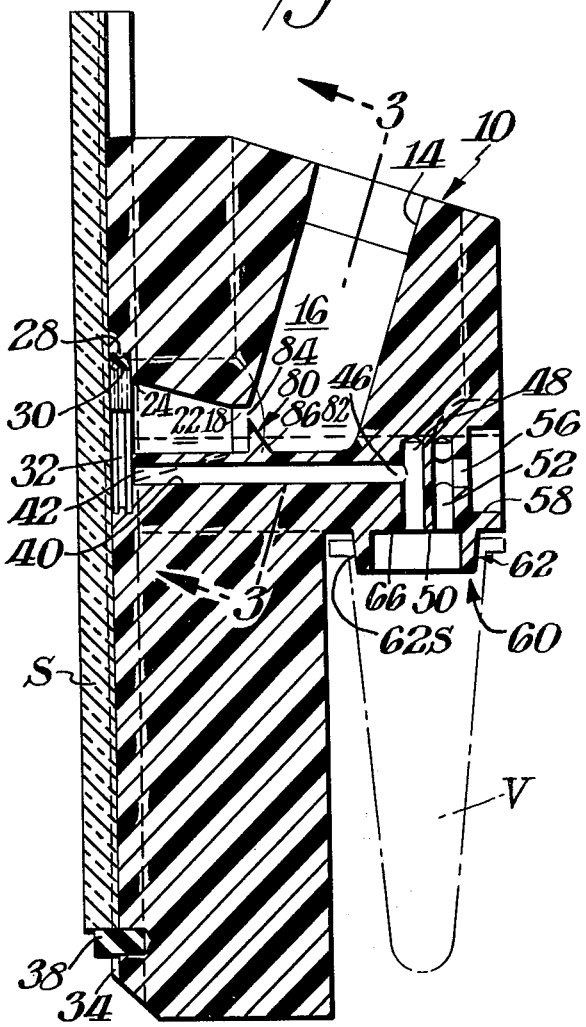
Fig. 3.
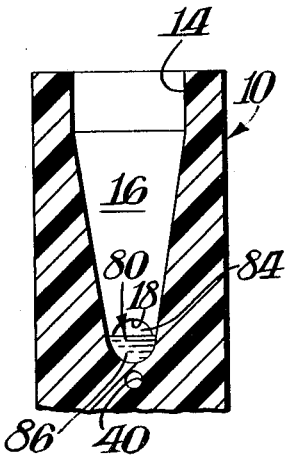
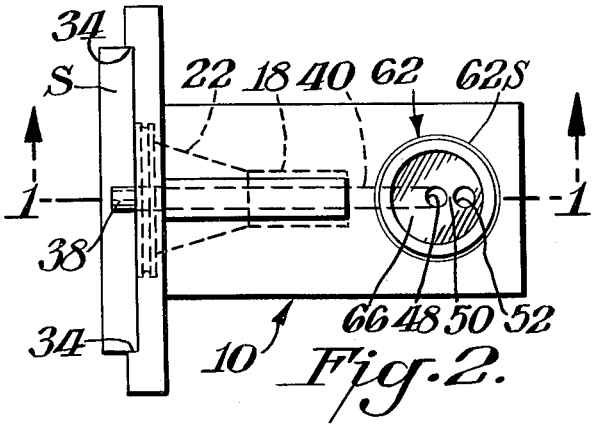
Fig. 2.

CHAMBER BLOCK HAVING A SAMPLE DAM AND A SUPERNATANT REENTRY BARRIER THEREIN

FIELD OF THE INVENTION

This invention relates to a chamber block useful with a centrifuge rotor of the type adapted to deposit particles suspended within a supernatant onto a deposition surface and, in particular, to a chamber block having a dam to prevent premature flow of a sample through the block and a reentry barrier to prevent supernatant from reentering the block.

BACKGROUND OF THE INVENTION

The centrifuge rotor arrangement such as described in United States Patent Application Ser. No. 15,911, filed Feb. 28, 1979 and U.S. Pat. No. 4,314,523 (Boeckel et al.) issued Feb. 9, 1982 is adapted to deposit particles, such as cells, suspended in a liquid medium known as a supernatant onto a suitable deposition surface, such as microscope slide, so that further examination of the cells may occur. The rotor arrangement utilizes a removable chamber block mountable therein. Each chamber block is provided with an inlet channel for receiving a sample containing a supernatant having particles suspended therein and an outlet channel through which the particles and supernatant are moved under the influence of centrifugal force onto the deposition surface. A supernatant withdrawal conduit, or cannula, extends through the body of the chamber block to collect supernatant by drawing the same under suction in a rearward direction from the deposition surface.

U.S. Pat. No. 4,306,514 (Bouclier) issued Dec. 22, 1981 and U.S. Pat. No. 4,327,661 (Boeckel) issued May 4, 1982 disclose chamber blocks having a deflection baffle disposed within the block and arranged such that supernatant withdrawn through the withdrawal conduit from the vicinity of the slide is deflected into a collection receptacle or into a collection vial introduced into an opening formed in the chamber block.

Observations have indicated the possibility that a sample of particles and supernatant introduced into the inlet channel may run through the block into a collection vial before the particles have had an opportunity to deposit onto the deposition surface. This possibility is enhanced if withdrawal suction is applied to the block before the particles have been subjected to the centrifugal force field. Furthermore the possibility has been raised that once collected in the vial the supernatant may be urged to reenter the block. Thus, it may be necessary to require that an operator remove supernatant previously collected in order to prevent reentry of the already withdrawn supernatant into the cannula. Both these possibilities are also believed to be disadvantageous.

In view of the foregoing it is believed advantageous to provide a chamber block wherein the possibility of sample run-through or supernatant reentry is minimized.

DISCLOSURE OF THE INVENTION

The instant invention relates to a chamber block adapted for movable insertion into and out of a centrifuge rotor. The chamber block includes an inlet channel for receiving a sample containing a supernatant having particles suspended therein and an outlet channel through which the particles and supernatant move under the influence of centrifugal force toward a deposition surface. The chamber block is of the type having a conduit through which a supernatant is withdrawn by suction from the region of a deposition surface onto which particles carried by the supernatant have been deposited by centrifugal force. The block includes a deflection baffle disposed in a location so as to deflect the supernatant withdrawn through the conduit into a collection vial.

In accordance with this invention a dam is mounted within the block in a position so as to cooperate with the inlet channel to define a well which receives the sample. In the absence of a centrifugal force field the dam retains the sample in the well. As the block is subjected to a centrifugal force the supernatant and cells suspended therein are urged over the dam and onto the deposition surface.

In another aspect of this invention a retaining wall is defined by a portion of the chamber block to serve as a barrier to prevent the reentry of previously removed supernatant into the cannula.

BRIEF DESCRIPTION OF THE DRAWINGS

The invention will be more fully understood from the following detailed description thereof taken in connection with the accompanying drawings which form a part of this application and in which FIG. 1 is a side elevation view, entirely in section, of a chamber block embodying the teachings of the present invention;

FIG. 2 is a bottom view of the chamber block shown in FIG. 1; and,

FIG. 3 is a section view of the chamber block shown in FIG. 1 taken along section lines 3—3 therein.

DETAILED DESCRIPTION OF THE INVENTION

Throughout the following detailed description similar reference numerals refer to similar elements in all figures of the drawings.

Shown in FIG. 1 is a side elevation view entirely in section of a chamber block generally indicated by reference character 10 having a sample retaining dam and a sample reentry barrier in accordance with the teachings of this invention. The chamber block is useful with centrifuge rotors of the type described in U.S. Pat. No. 4,314,523 (Boeckel et al. ) which is hereby incorporated by reference for necessary details of the construction, operation or interaction between the centrifuge rotor and chamber block.

The chamber block 10, preferably injection molded from a clear polycarboante or polysulfone material, includes an inlet orifice 14 communicating with an inlet channel 16. The inlet channel 16 is inclined a predetermined angle, typically at about twenty degrees with the vertical, to preclude supernatant or particles suspended therein from being centrifuged from the block 10 other than in the manner intended. The block 10 may be provided with a cover (not shown) if desired. The lower end of the inlet channel 16 communicates through a transition region 18 to a divergent outlet channel 22 terminating in an outlet orifice 24.

The chamber block 10 is provided with a recess 28 in the vicinity of the outlet orifice 24 to receive a suitable gasket 30. The recess 28 has a projection 32 therein which retains the gasket 30 within the block 10. As seen best in FIG. 2, the chamber block 10 is provided with suitable surfaces 34 adapted to define a trackway which receives a deposition surface S in a manner so as to prevent movement of the surface S with respect to the block 10. An abutment 38 is mounted with the block 10 to define a stop against which the surface S rests.

A supernatant withdrawal conduit or canulla 40 is provided within the body of the chamber block 10. One end 42 of the conduit 40 is disposed in the vicinity of the outlet orifice 24 and lies within a predetermined close distance of the deposition surface S. This end 42 of the conduit 40 lies with in the region bounded by the gasket 30. The inner end 46 of the conduit 40 opens into a cutout region 48 suitably defined as by a bore provided in the body of the block 10. A baffle 50 is disposed within the block 10, the baffle 50 being disposed intermediate the cutout region 48 and a second cutout region 52 also suitably defined as by a bore in the body of the block 10. The second cutout region communicates through a bore 56 and a nozzle receptacle 58 to a suitable suction source, as described in U.S. Pat. No. 4,314,523 incorporated by reference above.

The chamber block 10 includes a collection vial retaining arrangement 60 in the form of an annular ring member 62 which depends downwardly from the body of the block 10. The ring 62 surrounds the deflection baffle 50 and the cutout regions 48 and 52 cooperating to define the same. A barrier ledge 66 is defined between the cutout region 48 and the inner surface of the ring for a purpose discussed herein. If desired, the outer surface 62S of the ring 60 may be frustoconical (with the larger base of the frustum disposed adjacent the block 10) to assist in retaining a suitable collection vial V preferably of the Eppendorf type thereon. Whatever its profile the outer surface 62S of the ring 60 is sized to closely fit into and snugly receive a supernatant collection vial and position the same to receive supernatant withdrawn through the canulla 40 and deflected by the baffle 50.

As seen in FIGS. 1 and 3, a dam 80 is provided at the lower end of the inlet channel 16. The dam 80 cooperates with the lower portion of the inlet channel 16 to form a well, generally indicated by the reference character 82, which receives a sample comprising supernatant and particles suspended therein. The dam 80 prevents a sample from running through the block 10 in the absence of a centrifugal force field. Until the rotor is rotated, the sample is contained with the well 82. As the centrifugal force field builds upon rotation of the rotor in which the block is disposed the sample is urged by centrifugal force over the dam 80 and into the transition region 18 toward the outlet channel 22 through a clearance 84 (FIG. 3) defined between the top of the dam 80 and the boundary of the transition region 18. The surface 86 of the dam 80 presented to the well 82 is preferably inclined or curved to assist in sample passage from the well 82. The dam 80 may be placed in any suitable location within the inlet channel 16, the transition region 18 or the outlet channel 22 to effect the purposes above discussed.

In operation a collection vial V, such as an Ependorf tube, is inserted onto the ring 62 so that the outer surface 62S of the ring snugly receives the inner surface of the collection vial. The dam 80 prevents sample run-through until the centrifugal force field urges the sample over the dam 80, through the clearance 84 and into the transition region 18 toward the outlet channel 22.

Once the excess supernatant is withdrawn into the collection vial reentry of the supernatant in response to a centrifugal force is prevented by the presence of the barrier defined by the ledge 66.

Those skilled in the art having benefit of the teachings hereinabove set forth may effect numerous modifications thereto. These modifications are to be construed as falling within the scope of the present invention, as defined by the appended claims.

What is claimed is:

1. In a chamber block adapted for removable insertion into a centrifuge rotor, the block being of the type having an inlet channel into which a sample is introduced and an outlet channel through which the sample moves in response to a centrifugal force field toward a deposition surface, wherein the improvement comprises:

a dam formed within the block and cooperating with the structure of the block to define a well on the interior thereof to receive the sample and to prevent the sample from flowing through the block in the absence of a centrifugal force field.

2. The chamber block of claim 1 wherein the surface of the dam presented to the well is inclined.

3. The chamber block of claim 1 wherein the sample includes particles suspended in a supernatant, the block having a conduit through which the supernatant is withdrawn from the region of the deposition surface, the block having a retaining arrangement adapted to receive a supernatant collection vial thereon and a baffle to deflect supernatant withdrawn through the conduit into the collection vial, wherein the improvement further comprises:

a barrier formed within the block and arranged to inhibit flow of supernatant from the vial into the conduit while the block is subjected to a centrifugal force field.

4. The chamber block of claim 3 wherein the surface of the dam presented to the well is inclined.

* * * * *